United States Patent [19]

Crouse

[11] Patent Number: 4,846,400

[45] Date of Patent: Jul. 11, 1989

[54] METHOD OF AND APPARATUS FOR AUTOMATIC DAMPER CONTROL

[76] Inventor: Scott L. Crouse, 4242 Grand Ave. South, Minneapolis, Minn. 55409

[21] Appl. No.: 180,456

[22] Filed: Apr. 12, 1988

[51] Int. Cl.[4] ..... F23N 3/00

[52] U.S. Cl. ..... 236/93 R; 126/285 B; 431/20

[58] Field of Search ..... 236/1 G, 16, 45, 93 R, 236/95, 96; 431/20; 110/163; 126/285 B, 286, 290, 292

[56] References Cited

U.S. PATENT DOCUMENTS

| | | | |
|---|---|---|---|
| 1,452,792 | 4/1923 | Copper, Jr. | 236/93 R |
| 1,659,875 | 2/1928 | Jacobs | 236/93 R |
| 1,784,608 | 12/1930 | Meyers | 236/93 R |
| 4,084,743 | 4/1978 | Matthews et al. | 126/286 X |
| 4,108,369 | 8/1978 | Prikkel, III | 126/285 B X |
| 4,389,014 | 6/1983 | Chow | 126/285 B X |
| 4,479,483 | 10/1984 | Raihala | 236/96 X |
| 4,550,874 | 11/1985 | Clouser et al. | 431/20 X |

*Primary Examiner*—Harry B. Tanner
*Attorney, Agent, or Firm*—Henry C. Kovar

[57] ABSTRACT

A method of and apparatus for automatic flue damper control of a solid fuel burning stove has a driveshaft connected to the damper, a plurality of cams on the driveshaft, a plurality of thermoswitches on the chimney pipe, a plurality of selection switches operated by the cams, and an electric motor controlled by the thermoswitches and the selector switches for moving the damper to open, partial and closed positions in response to low, rising, and too high temperatures respectively.

25 Claims, 2 Drawing Sheets

| | | | |
|---|---|---|---|
| O | C | C | SWL(52) |
| C | O | O | SWM(54) |
| C | C | O | SWH(50) |

METHOD OF AND APPARATUS FOR AUTOMATIC DAMPER CONTROL

BACKGROUND OF THE INVENTION

1. Field of the Invention

This invention pertains to a method and apparatus for automatic control of a chimney damper for a solid fuel stove.

2. The Prior Art

Each year nearly 100,000 chimney fires result in considerable property damage and personal injury. Wood and coal-burning stoves account for a large majority of these fires because these types of fuels tend to produce large amount of highly flammable creosote which lines the chimney during normal operation. When the temperature inside a chimney reaches 1,000 degrees–1,500 degrees f, this creosote can ignite resulting in a fire which is very difficult to control or contain.

During normal operation of a wood or coal-burning stove, gaseous creosote is sent through the chimney. This creosote condenses on the cool walls of the chimney and forms a thick, black coating. This hardened creosote is highly flammable and can easily ignite if the stove accidently overheats. Once ignited, creosote fires burn at an uncontrollable rate and can reach temperatures of nearly 2000 degrees F. This results in a very dangerous situation.

Collapse of pipes and splitting of pipes is a result. The worst scenario is ignition of the building and loss of life in the subsequent fire. This has been happening all too frequently.

OBJECTS OF THE INVENTION

It is an object of this invention to greatly reduce the possibility of a chimney fire by automatically adjusting the flue damper ensuring that the temperature inside the chimney remains at a safe level.

It is an object of this invention to prevent creosote build up in chimneys.

It is an object of this invention to provide an effective low cost automatic method of and control for the damper of a solid fuel burning stove.

It is an object of this invention to provide a wood burning stove having an automatic damper control for maintenance of the chimney temperature within a predetermined range.

SUMMARY OF THE INVENTION

An automatic control for a solid fuel stove damper has a chassis mountable with respect to a stove pipe, a high temperature sensor, a low temperature sensor, an electric motor, and selection switches to transfer control of the motor back and forth between the high and low temperature sensors upon completion of a previous damper position change.

A solid fuel burning stove has a chimney, a chimney damper, a chassis mounted to the chimney, an electric motor on the chassis and connected to turn the damper, high and low temperature sensors, and selector switches responsive to damper position for selectively connecting a preferred one of the temperature sensors to the motor upon completion of a cycle of damper movement.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
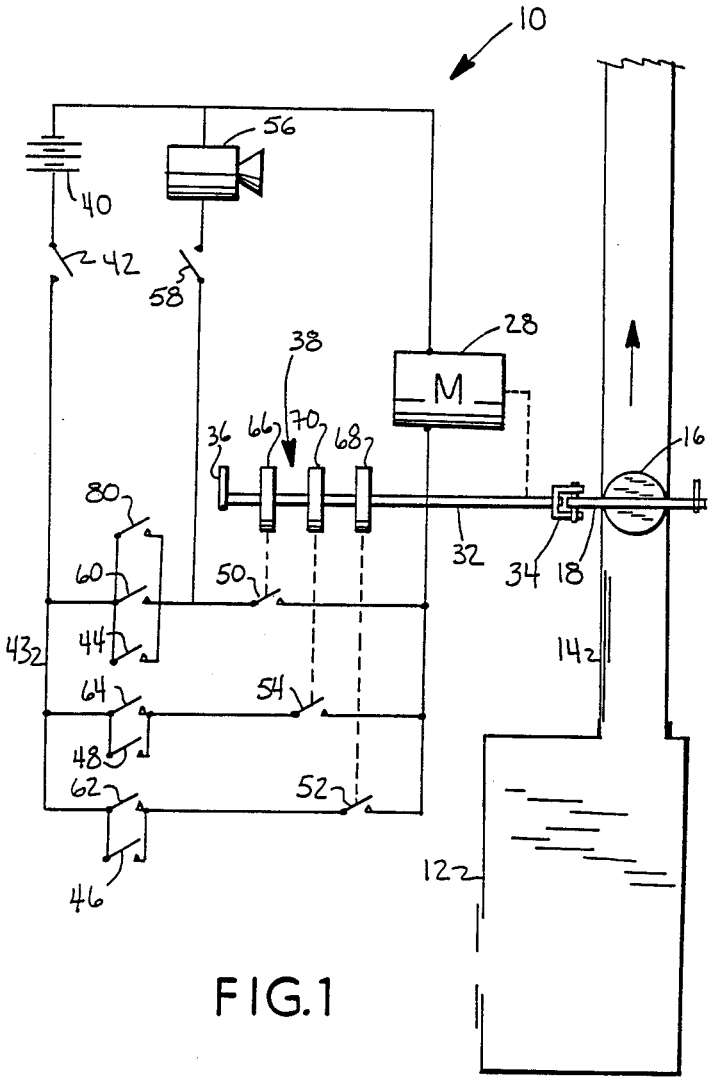
FIG. 1 is an electrical schematic of the preferred embodiment of the present invention.
Figure 2:
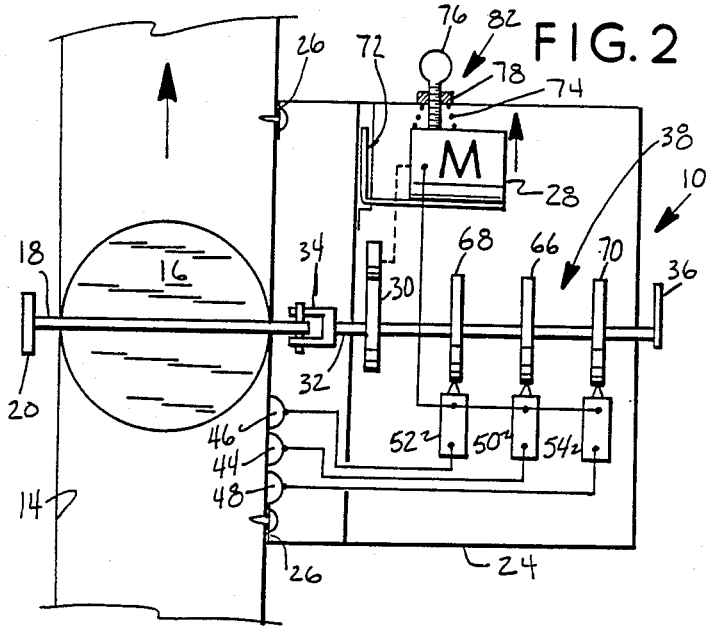
FIG. 2 is an elevational sectioned view of the preferred physical structure of the present invention.

According to the principles of the present invention, an automatic damper control is provided as shown in FIGS. 1 & 2 and generally indicated by the numeral 10. A solid fuel, specifically wood or coal, stove 12 has an upward extending chimney pipe 14 in which a rotatable flue damper 16 is co-pivotally mounted upon a rotatable damper shaft 18 independently journaled in the pipe 14. The damper shaft 18 has a combination manual handle and position indicator 20 on one end and a drive key 22 on the other end.

A control chassis 24 is preferrably made of sheet metal formed into a U-shape. Two distal ends 26 of the chassis 24 are fastened directly to the stove pipe 14. An electric motor 28, preferrably a low voltage DC motor that will run off a small battery, is mounted to the chassis 24 and is operatively connected by a belt drive or gear train 30 to a rotatable driveshaft 32. The driveshaft 32 is independently journaled to the chassis 24 and is mounted co-axially with the damper shaft 18 and has on its inner end a slip coupling 34 which axially slips into rotary engagement with the key 22 for positive rotational drive of the damper shaft 18 and therefore the damper 16. On the outer end of the driveshaft 32 is a damper position indicator 36 which is aligned with the damper 16. A plurality of selector cam surfaces, generally indicated by the numeral 38 are co-rotatably keyed to and mounted upon the driveshaft 32. Power of the motor 28 is provided by a battery 40 mounted within the chassis 24 and wired through a master on/off switch 42. The circuit from the master switch 42 has a motive power source lead 43 that leads in parallel to a plurality of manually function switches and thermostatic switches.

A first and higher temperature (HT) thermoswitch 44, a second and lower temperature (LT) thermoswitch 46, and a middle temperature (MT) thermoswitch 48 are all preferrably bi-metallic mechanical switches wired in parallel to via the motive power source lead 43 the master switch 42 and fastened directly upon the outside of the chimney pipe 14. The HT thermoswitch 44 is open below 500 degrees F. and is closed at 500 degrees F. and higher temperature. The LT thermoswitch 46 is closed at temperatures of 300 degrees F and below and opens when the temperature goes above 300 degrees F. The MT thermoswitch 48 is open at temperatures below 400 degrees F. and is closed at temperatures of 400 degrees F. and above. The HT thermoswitch 44 is wired in series via a HT selector switch 50 to the motor 28. The LT thermoswitch 46 is wired in series via a LT selector switch 52 to the motor 28. The MT thermoswitch 48 is wired in series via a MT selector switch 54 to the motor 28. An acoustic and/or illuminated high temperature alarm 56 is wired in parallel with the HT selector switch 50 to the HT thermoswitch 44.

The alarm 50 may have its own discrete on/off switch 58.

A normally open HT test switch 60 is connected in parallel with the HT thermoswitch 44 between the battery 40 and the HT selector switch 50. The HT test switch may be manually utilized to be certain the damper 16 fully closes. A normally open LT test switch 62, which also serves as a reset switch, is connected in parallel with the LT thermoswitch 46 to the LT selector switch 52. A normally open MT test switch 64 is connected to the MT selector switch 54 in parallel with the MT thermoswitch 48. Each of the test switches 60, 62, 64 is manually and momentarily operable by an actuator on the outside of the chassis 24. Test switches 60, 62, 64 manually and visually provide assurance of proper damper 16 operation.

There are three discrete cam profiles 66, 68, 70 that discretely operate the selector switches 50, 52, 54 respectively. The three cam profiles 68, 66, 70 are illustrated in FIG. 3 with sequentially smaller major diameters; in practice the major diameters are identical but sequential diameters are utilized for easier illustration.

Figure 3:
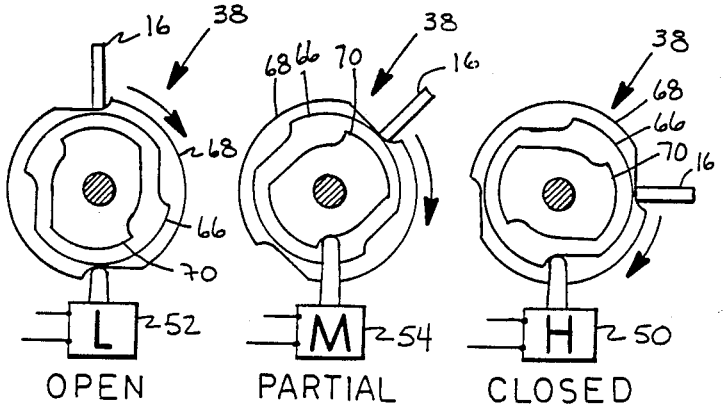
FIG. 3 is a cam timing diagram of the device of FIGS. 1 & 2.

When the damper 16 is open, as shown in the left view in FIG. 3, cam 66 and cam 70 present their major diameter to selector switches 50 and 54 which are held closed. Cam 68 presents its detent and selector switch 52 is open.

When the damper 16 is partially closed/open as shown in the center of FIG. 3, cam 66 and cam 68 present their major diameter to selector switches 50 and 52 which are held closed. Cam 70 presents its detent and selector switch 54 is open.

When the damper 16 is closed as shown in the right side of FIG. 3, cam 68 presents its major diameter and selector switch 52 is closed. Cam 66 and cam 70 each present a detent to selector switches 50 and 54 respectively which are both open.

Cam 68 has an opposed pair of detents, each of which is less than 45 degrees in length. Cam 66 has an opposed pair of detents, each of which is less than 45 degrees in length. The detents of cam 68 and cam 66 are staggered at right angles to each other. The detents on cam 68 are parallel to the damper 16 and the detents on cam 66 are at right angles to the damper 16.

Cam 70 which is the cam for the MT selector switch 54 has opposed detents, each of which is about 45 degrees in length.

All of the cams 68, 66, 70 are keyed together and co-rotate only in one direction, clockwise is shown in FIG. 3.

The detent drop into cam 70 is spaced behind the detent drop of cam 68 about 45 degrees; a preferred range of spacing is in the range of 30 to 60 degrees. This spacing and its angular relevance to the damper 16 position, determines the position of the damper 16 in the partial position; a lesser spacing provides more opening and a greater spacing provides more closing of the damper 16. The detent of cam 70 then extends from the drop to past the detents of cam 66. Therefore, cams 66, 68 have single position detents whereas cam 70 has two position detents. LT selector switch 52 is closed in the damper partial and closed positions. HT selector switch 50 is closed in both damper open and partial positions. MT selector switch 54 is closed only in the damper open position.

The motor 28 is preferrably mounted to the chassis 24 with a tongue and groove sliding mount 72 enabling the belt or gear train 30 to be selectively engaged or disengaged. A spring 74 normally biases the gear train 30 downward into engagement. A pull bolt 76 extending through a larger hole in the chassis 24 enables lifting and pulling of the motor 28 up and away from the driveshaft 32 for disengagement of the gear train 30. A hold-off nut 78 can then be tightened to hold the gear train 30 up in a disengaged mode. In this disengaged mode, the damper 16 is manually operable by either the handle 20 or indicator 36. Were a belt drive used, the disengagement mechanism 82 would alternately move the motor 28 closer to the driveshaft 32 for disengagement. When the motor 28 is operatively disengaged from the damper 16, the master power switch 42 is open, as shown in FIG. 1, to open the power lead to the selector switches 50, 52, 54 and prevent the motor 28 from needless running.

Alternatively, the damper shaft 18 and driveshaft 32 may be upright in a horizontal length of pipe 14 (not shown) and the damper 16 will be rotatable about a vertical axis. The spring 74 in between the motor 28 and the chassis 24 biases the motor 28 towards the driveshaft 32 and keeps the gear train 30 engaged. The control 10 will function regardless of whether it's horizontal or vertical.

In operation and use of the control 10 and in the practice of the method of the present invention, the LT test switch 62 (which is also a reset switch) is manually actuated. If the damper 16 is opened it will remain open. If the damper 16 is either partially or completely closed, it will rotate to open. The fire is then lit and hot combustion product goes up the pipe 14. Creosote build up is prevented by allowing free burning while the chimney 14 is warming up. When the chimney 14 temperature goes above 300 degrees F., LT thermoswitch 46 opens; nothing happens. When the temperature reaches 400 degrees F., MT thermoswitch 48 closes and power is fed via closed MT selector switch 54 to the motor 28 which begins turning the damper 16 and cams 38. When the damper 16 and cams 38 reach the partial position, MT selector switch 54 is opened and both the HT selector switch 50 and the LT selector switch 52 are closed. Both the HT thermoswitch 44 and LT thermoswitch 46 should be open.

Now temperatures can hold, go up, or go down. If the temperature holds between 300 and 500 degrees F. nothing further happens and the damper 16 remains in the partial position. When the subsequent temperature falls below 400 degrees F., the MT thermoswitch 48 opens but nothing happens. However, when the temperature further drops to below 300 degrees F., the LT thermoswitch 46 closes and provides power to the motor 28 which then turns the damper 16 firstly to closed and then past closed and back to the open position to increase air flow and burning to bring the temperature back up.

When the damper 16 reaches open, LT selector switch 52 is opened and MT and HT selector switches 54, 50 are closed. When the damper 16 is in the partial position and the temperature subsequently rises above 400 degrees F., the damper 16 remains in the partial position and nothing happens until 500 degrees F. is reached whereupon the HT thermoswitch 44 will close and provide power through the HT selector switch 50 to power the motor 28 for moving the damper 16 and cams 38 to the closed position for choking off the fire and reducing the temperature. When the HT thermoswitch 44 is closed, the alarm 56 sounds until it is manually shut off. When the damper 16 reaches the closed position, both the MT and HT selector switches 54, 50 are opened and only the LT selector switch 52 is closed. The chimney 14 temperature must then drop all the way down to 300 degrees F. to enable reopening of the damper 16 by virtue of the LT thermoswitch 46 closing.

The control 10 modulates the damper 16 into and through the partial position as the chimney 14 temperature is rising, but completely closes the damper 16 without modulation when the chimney 14 temperature exceeds the predetermined high temperature. The HT and MT test switches 60, 64 will each respectively override the thermoswitches 46, 44, 48 and place the damper 16 in the closed or partial position respectively. However, when the chimney pipe 14 temperature is below 300 degrees F., the damper 16 will automatically return to open by the closed LT thermoswitch 46. This helps prevent smoke damage as a consequence of the stove user unintentionally forgetting to open the damper, and prevents creosote build up when lighting and starting the fire. A second HT thermoswitch 80 can be mounted near the outlet of the pipe 14 and will shut off the damper 16 in the event of a chimney fire up above the control 10. The second HT 80 thermoswitch would be wired in parallel with the HT thermoswitch 44 and HT test switch 60.

The specific operative temperatures of the thermoswitches 44, 46, 48, 80 can be varied from what has been described as the preferred temperatures. Usage of a single thermocouple and solid state device to replace the discrete thermoswitchs is comtemplated. Both the damper shaft 18 and driveshaft 32 are co-rotatable on a common horizontal axis, and the motor 28 also has its shaft on a horizontal axis.

This control 10 and its method of operation greatly enhance the effectiveness and safety of a solid fuel burning stove. Chimney overheat is prevented, and the probability of a fire or pipe breakage is greatly reduced. The problems of the prior art, as herein discussed, are overcome and the objects of the invention are solved and satisfied.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. An automatic temperature responsive electrical damper control for operation of a damper in a solid fuel stove, comprising a. a chassis having means for mounting of the chassis in a predetermined position with respect to and adjacent a chimney pipe from the solid fuel stove;

b. an electric motor mounted to said chassis; a damper drive connected to said motor and operatively connectable to a damper in said chimney pipe for position movement of the damper;

c. output means connected to said damper drive for indicating the position of the drive and the damper when operatively connected to said drive;

d. temperature responsive switching means for switching in response to a first higher temperature and a functionally discrete second lower temperature, said switch means being positionable in thermal exchange relationship with said chimney pipe;

e. selection means operatively connected to said output means and functionally disposed between said motor and said switch means for connecting said motor to be responsive only to switching as a consequence of only one of said temperatures; and f. a power source lead connected to said selection means.

2. The control of claim 1, in which said output means is a shaft and rotary positional indicator which has said damper drive on one end of said shaft.

3. The control of claim 1, in which said switch means comprises a discrete first high temperature switch and a discrete second lower temperature switch being discretely connected through said selection means to said motor.

4. The control of claim 1, in which said switch means includes means for switching in response to a middle temperature in between said first and second temperatures.

5. The control of claim 4, in which said switching means includes three discrete mechanical thermoswitches, said selector means includes three discrete normally open switches connected one each to a respective thermo-switch, and including a selector cam having three lobes co-rotatably mounted on said damper drive, there being a discrete lobe for each selector switch.

6. The control of claim 1, in which said selection means includes a discrete switch for each of said temperatures, said switches being electrically connected in parallel to said motor.

7. The control of claim 1, including a reset switch in parallel with the said lower temperature switch means.

8. The control of claim 1, including a high temperature alarm wired in parallel with the motor between the said higher temperature switching means and a common power lead.

9. The control of claim 1, including means for mechanically disengaging said motor from said damper drive.

10. The control of claim 9, in which said disengaging means includes a manually operable mechanical element for physically moving the motor out of mechanical engagement with the damper drive.

11. The control of claim 10, including a slide mount in said chassis, said motor being slideably mounted in said slide mount with said mechanical element being connected between the motor and the chassis and being operable for slideably changing said motor from an engaged position to a disengaged position.

12. The control of claim 9, including a main power switch operatively connected to said motor between said motor and a power source for opening said power source lead when said motor is disengaged.

13. The control of claim 12, including an actuator on the outside of the chassis for turning said control on and off.

14. The control of claim 9, including a spring normally biasing said motor into engagement with said driveshaft.

15. The control of claim 1, including a test switch connected in parallel with the temperature sensing means to said selection means, for testing full closing of the damper in response to a sensing of a predetermined too-high temperature.

16. In a solid fuel burning stove having a solid fuel burning chamber, an air inlet to the chamber, a chimney pipe extending upward from the burning chamber for exhaust of combustion product from the burning of solid fuel, and a damper in the chimney pipe, the improvement of an automatic temperature responsive damper control comprising a. an electric motor;

b. drive means operatively connecting the motor to said damper for movement of the damper between open and closed position;

c. output means connected to said drive means for indicating the position of the damper as being open or closed;

d. first and second temperature responsive switches having means positioned for sensing chimney temperature, said switches being self actuatable upon the sensing of a predetermined temperature, said first switch being self actuatable at a higher temperature than the second switch;

e. selection means operatively connected to said output means and functionally disposed between said motor and said switches for selective switching electrical connection of the motor between said first and second switches and vice-versa in response to said output means indicating a change in position of the damper to open or closed; and f. a motive power lead connected to both said switches for energizing said motor to move said damper upon thermally responsive actuation of said switches to which the motor is electrically connected.

17. The stove and control of claim 16, including a middle said temperature responsive switch connected through said selection means for positioning the damper partially open in the chimney pipe.

18. The stove and control of claim 16, in which said temperature responsive switches are thermo-switches mounted on the outside of the chimney pipe below the damper.

19. The stove and control of claim 16, in which said first switch is functionally connected to said output means for positioning the damper completely closed.

20. The stove and control of claim 16, including means for selectively engaging or disengaging said motor with or from said drive means, and means for opening a motor power circuit upon disengaging, for turning off the control and enabling manual operation of the damper.

21. The stove and control of claim 16, in which said damper shaft is rotatable about a vertical axis, and including a spring between the motor and the chassis, said spring biasing the motor into driving engagement with the draftshaft.

22. A method of automatically controlling a chimney damper, comprising the steps of:

a. sensing the temperature of gases in a chimney having a damper therein;

b. operating a lower temperature thermo-switch in response to sensing a low threshold temperature;

c. connecting motive power to an electric damper drive motor and moving the damper to a fully open position in response to said operation of the low threshold temperature;

d. dropping out the lower temperature switch and bringing in a higher temperature thermoswitch when the damper stops in the open position, and subsequently e. sensing a high threshold temperature and in response thereto operating a higher temperature thermo-switch and connecting motive power to the motor, f. moving the damper to a fully closed position, and g. dropping out the higher temperature switch and bringing back in the lower temperature switch when the damper stops in the closed position.

23. The method of claim 22, including the further steps of:

a. bringing in a middle temperature switch when the damper stops at the open position;

b. sensing a predetermined middle temperature and energizing the motor in response thereto;

c. moving the damper to a partially opened position; and d. dropping out the middle temperature switch and bringing in the lower and higher temperature switches when the damper stops in the partially opened position.

24. The method of claim 23, including the further steps of dropping out the middle temperature switch when the damper is in the closed position.

25. The method of claim 22, including the further step of mechanically disengaging the motor from the damper while the motor remains mounted to the chimney, and enabling alternate manual operation of the damper.

* * * * *